United States Patent [19]

Nickolai

[11] Patent Number: 4,914,315

[45] Date of Patent: Apr. 3, 1990

[54] METHOD FOR LOOSENING THE CONTACTS OF A STICKING RELAY AS WELL AS CIRCUIT ARRANGEMENT FOR CARRYING OUT THE METHOD

[75] Inventor: Norbert Nickolai, Laufen, Fed. Rep. of Germany

[73] Assignee: Bayerische Motoren Werke AG, Munich, Fed. Rep. of Germany

[21] Appl. No.: 204,852

[22] Filed: Jun. 10, 1988

[30] Foreign Application Priority Data

Jun. 10, 1987 [DE] Fed. Rep. of Germany ..... 3719298

[51] Int. Cl.[4] ..... H01H 47/12

[52] U.S. Cl. ..... 307/137; 307/129; 361/170; 361/203

[58] Field of Search ..... 307/137, 138, 134, 142, 307/132 R, 132 E, 132 V, 132 M, 132 EA, 129; 361/153, 160, 170, 186, 203, 187; 340/644; 200/DIG. 42

[56] References Cited

U.S. PATENT DOCUMENTS

| | | | |
|---|---|---|---|
| 3,958,198 | 5/1976 | Minks | 335/128 |
| 4,254,391 | 3/1981 | Gould | 335/119 |
| 4,645,886 | 2/1987 | Williams | 200/1 R |
| 4,769,737 | 9/1988 | Ogita et al. | 361/203 |

FOREIGN PATENT DOCUMENTS

| | | |
|---|---|---|
| 0109540 | 10/1983 | European Pat. Off. . |
| 1639005 | 5/1970 | Fed. Rep. of Germany . |
| 1928371 | 2/1971 | Fed. Rep. of Germany . |
| 3333833 | 4/1985 | Fed. Rep. of Germany . |

*Primary Examiner*—Derek S. Jennings
*Assistant Examiner*—David Osborn

[57] ABSTRACT

A method for releasing the contacts of a sticking relay by sensing whether or not the relay contacts stick together in a closed condition and when the contacts stick together, applying an AC voltage on pulsating DC voltage to the winding of the relay coil. The mechanism for sensing the sticking relay contact condition is a comparator to compare the output load of the relay with the exciting control signal to energize the relay coil.

14 Claims, 1 Drawing Sheet

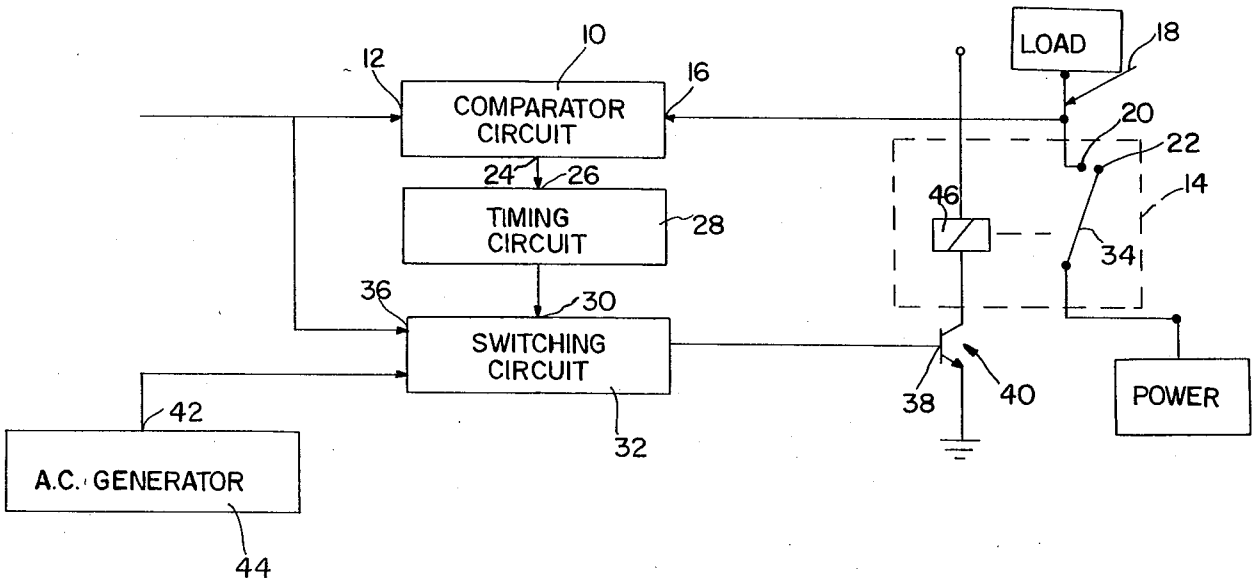
LOAD
POWER
COMPARATOR CIRCUIT
TIMING CIRCUIT
SWITCHING CIRCUIT
A.C. GENERATOR
10
12
14
16
18
20
22
24
26
28
30
32
34
36
38
40
42
44
46

METHOD FOR LOOSENING THE CONTACTS OF A STICKING RELAY AS WELL AS CIRCUIT ARRANGEMENT FOR CARRYING OUT THE METHOD

BACKGROUND AND SUMMARY OF THE INVENTION

The present invention relates to a method for unsticking (disengaging) the contacts of a sticking relay whose one contact is arranged locally fixed and whose other contact is arranged at the ferromagnetic relay armature which is attracted with its contact toward the locally fixed contact by the application of an electric voltage to the winding of the relay coil and which drops off again in the de-energized condition of the relay coil with an intact relay whereby the two contacts are again separated from one another.

In electric circuits, load current circuits are frequently switched with the aid of electric relays. However, the disadvantage of these electric relays resides in that the relay contacts at times stick together by reason of the high electric current to be switched, i.e., are welded together by the electric arc occurring during the switchingof the relay. If the relay contacts remain stuck together, the loads arranged in the load current circuit of the relay are frequently destroyed.

It is therefore the object of the present invention to provide a method for the loosening or disengagement of the contacts of a sticking relay, by means of which a destruction of the loads arranged in the load circuit of the relay can be prevented.

The underlying problems are solved according to the present invention in that a sticking together of the relay contacts is determined and in the case of sticking relay contacts, an alternating current (a.c.) voltage or a pulsating d.c. voltage is applied to the winding of the relay coil.

By means of the a.c. voltage or pulsating d.c. voltage applied to the winding of the relay coil when relay contacts stick together, the relay armature is shaken or vibrated by the force exerted thereon by the relay coil, as a result of which the for the most part brittle connecting layer between the relay contacts breaks and the relay again drops off. It is possible by this method to disengage again the sticking relay contacts so rapidly that a destruction of the loads arranged in the load circuit of the relay is prevented.

Preferably, an a.c. voltage or a pulsating d.c. voltage is applied to the winding of the relay coil with a frequency corresponding to the natural (resonant) frequency of the mechanical relay structure. As a result thereof, the relay structure is set into resonant vibrations.

In order to prevent a continuing shaking or vibrating at the relay armature in case that the connecting layer between the relay contacts does not break, the a.c. voltage or the pulsating d.c. voltage is applied advantageously to the winding of the relay coil only for a certain predetermined period of time.

According to a further feature of the method in accordance with the present invention, the development of the load signal to be switched by the relay is compared with the development of the control signal of the relay for the purpose of determining the sticking together of the relay contacts. If the development of the load signal does not follow the development of the control signal of the relay, taking into consideration the shifting time of the relay, then this means that the relay contacts are stuck together.

A circuit arrangement according to the present invention for carrying out the method includes advantageously a comparator circuit controlled at its one input by the control signal of the relay and connected with its other input to the load circuit to be switched by the relay, whose output signal controls a switching device, by means of which in lieu of the control signal of the relay the output signal of a generator producing an a.c. voltage or a pulsating d.c. voltage is adapted to be connected to the relay winding, respectively, to the control input of a relay driver controlling the electric current through the relay winding. In order to prevent a permanent shaking or vibrating of the relay armature when the connecting layer between the sticking relay contacts does not break, a timing circuit is preferably provided between the output of the comparator circuit and the control input of the switching device, which connects-through an output signal of the comparator circuit indicating sticking relay contacts to the control input of the switching device only for a finite predetermined period of time. This circuit arrangement is characterized in particular by its simple construction from a circuit point of view.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein:

The single FIGURE is a schematic block diagram of a circuit arrangement for carrying out the method in accordance with the present invention for disengaging the contacts of a sticking relay.

DETAILED DESCRIPTION OF THE DRAWINGS

Referring now to the single FIGURE of the drawing, the circuit arrangement according to the present invention includes a comparator circuit 10 which is controlled in its one input 12 by the control signal of the relay 14 indicated in the FIGURE in dash line and which is connected with its other input 16 to the load circuit 18 to be switched by the relay 14. A sticking-together of the relay contacts 20 and 22 is determined in the comparator circuit 10 in that the development of the load signal to be switched by the relay 14 is compared with the development of the control signal of the relay 14. If the load signal to be switched by the relay 14 does not follow the control signal of the relay, taking into consideration the switching time of the relay 14, then this means that the two relay contacts 20 and 22 are stuck together. The output 24 of the comparator circuit 10 is connected with the input 26 of a timing circuit 28. The timing circuit 28 connects-through the output signal of the comparator circuit 10, in case a sticking together of the relay contacts 20 and 22 has been determined, to the control input 30 of a switching device 32 for only a certain predetermined period of time. A continuing shaking or vibrating of the relay armature 34 is to be prevented with the aid of the timing circuit 28 when the connecting layer between the relay contacts 20 and 22 does not break even with repeated vibrating or shaking of the relay armature. Whereas the switching device 32 connects through the control signal of the relay 14 present at its one input 36 to the control input 38 of the relay driver 40 with an operable relay 14, in case the relay contacts 20 and 22 are stuck together, it connects the output 42 of an a.c. voltage generator 44 with the control input 38 of the relay driver 40. The relay driver 40 is alternately switched conducting and non-conducting by the alternating voltage produced by the a.c. voltage generator 44. As a result thereof, an a.c. voltage corresponding to the output voltage of the a.c. generator 44 is applied to the winding of the relay coil 46. The relay coil 46 produces in this manner a magnetic a.c. field which exerts a shaking or vibrating force on the relay armature 34. Preferably, the relay armature 34 is excited with the natural or resonant frequency of the mechanical structure of the relay 14 in order to cause the relay to vibrate at its resonant frequency. Owing to these measures, the relay contacts 20 and 22 are again reliably separated from one another so that the relay 14 is now again operable. The separation of the relay contacts 20 and 22 thereby takes place so rapidly that a destruction of the electric loads (not shown) which are arranged in the load circuit 18 of the relay 14, is prevented.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A method for releasing the contacts of a sticking relay, whose one contact is locally fixed and whose other contact is arranged at a ferromagnetic relay armature which is attracted with its contact toward the locally fixed contact by application of an electric voltage control signal to the winding of the relay coil and which in the de-energized condition of the relay coil, with an intact relay, again drops off whereby the two contacts are again separated from one another, comprising the steps of sensing if the one and other contacts stick together, and applying an AC or pulsating DC voltage to the winding of the relay coil when the one and other contacts stick together.

2. A method according to claim 1, wherein the a.c. or pulsating d.c. voltage is applied to the winding of the relay coil with a frequency corresponding substantially to a resonant frequency of the coil and armature.

3. A method according to claim 2, wherein the a.c. or pulsating d.c. voltage is applied to the winding of the relay coil only for a certain predetermined time period.

4. A method according to claim 3, wherein the sensing of the one and other contacts sticking-together is obtained by comparing a load signal to be switched by the relay with the control signal of the relay.

5. A method according to claim 1, wherein the a.c. or pulsating d.c. voltage is applied to the winding of the relay coil only for a certain predetermined time period.

6. A method according to claim 1, wherein the sensing of the one and other contact sticking-together is obtained by comparing a load signal to be switched by the relay with the control signal of the relay.

7. A circuit arrangement for releasing the contacts of a sticking relay whose one contact is locally fixed and whose other contact is arranged at a ferromagnetic relay armature which is attracted with its contact toward the locally fixed contact by applying an electric voltage control signal to the winding of the relay coil and which in the de-energized condition of the relay coil the two contacts are again separated from another, comprising first means for sensing if the one and other contacts stick together, and second means for applying an AC or pulsating DC voltage to the winding of the relay contact when the contacts stick together as sensed by said first means.

8. A circuit arrangement according to claim 7, wherein the frequency of the a.c. or pulsating d.c. voltage substantially corresponds to a natural frequency of the coil and armature.

9. A circuit arrangement according to claim 8, further comprising means for limiting the application of the a.c. or pulsating d.c. voltage to the winding of the relay coil for only a predetermined period of time.

10. A circuit arrangement according to claim 9, wherein the first means for determining the sticking condition includes comparing circuit means for comparing a load signal to be switched by the relay with the control signal of the relay.

11. A circuit arrangement according to claim 10, wherein the first means includes a comparator circuit controlled at its one input by the control signal for the relay and at its other input operatively controlled with a load circuit to be switched by the relay, whose output signal is operable to control a switching means operable to apply to the relay winding, in lieu of the control signal of the relay, the output signal of an a.c. voltage or pulsating d.c. voltage generator.

12. A circuit arrangement according to claim 11, wherein the switching means is operable to apply its output to a control input of a relay driver means controlling the electric current through the relay winding.

13. A circuit arrangement according to claim 12, wherein the means for limiting the application of the AC or pulsating DC voltage comprises a timing means between the output of the comparator circuit and the control input of the switching means which connects through an output signal of the comparator circuit indicating a sticking of the relay contacts for only a finite predetermined time period to the control input of the switching means.

14. A circuit arrangement according to claim 11, wherein the means for limiting the application of the AC or pulsating DC voltage comprises a timing means between the output of the comparator circuit and the control input of the switching means which connects through an output signal of the comparator circuit indicating a sticking of the relay contacts for only a finite predetermined time period to the control input of the switching means.

* * * * *